US005251889A

United States Patent [19]

Spencer et al.

[11] Patent Number: 5,251,889

[45] Date of Patent: Oct. 12, 1993

[54] SHEET HOLDING TRAY HAVING ADJUSTABLE SHEET EDGE GUIDES AND METHOD FOR ADJUSTING SHEET EDGE GUIDES

[75] Inventors: Christopher C. Spencer, Rochester; Raymond M. Quackenbush, Hilton; Michael J. Wendell, Webster, all of N.Y.

[73] Assignee: Eastman Kodak Company, Rochester, N.Y.

[21] Appl. No.: 933,624

[22] Filed: Aug. 24, 1992

[51] Int. Cl.[5] ..... B65H 1/00

[52] U.S. Cl. ..... 271/171; 271/3.1; 271/253; 271/223

[58] Field of Search ..... 271/171, 223, 253, 254, 271/3.1

[56] References Cited

U.S. PATENT DOCUMENTS

| | | | |
|---|---|---|---|
| 4,824,090 | 4/1989 | Booth, Sr. et al. | 271/223 X |
| 4,864,368 | 9/1989 | Muramatsu | 355/309 |
| 4,949,134 | 8/1990 | Iwaki et al. | 355/317 |

FOREIGN PATENT DOCUMENTS

| | | | |
|---|---|---|---|
| 102757 | 6/1984 | Japan | 271/171 |
| 133129 | 7/1984 | Japan | 271/171 |
| 212332 | 12/1984 | Japan | 271/171 |
| 51424 | 3/1986 | Japan | 271/171 |
| 48350 | 2/1990 | Japan | 271/254 |
| 81860 | 3/1990 | Japan | 271/171 |

*Primary Examiner*—Robert P. Olszewski
*Assistant Examiner*—Boris Milef
*Attorney, Agent, or Firm*—Tallam I. Nguti

[57] ABSTRACT

A reproduction appratus including a logic and control unit, and a sheet storage tray having selectable sheet alignment positions and a movable sheet edge guide for positioning at a selected sheet alignment position. A mechanism for automatically positioning the sheet edge guide includes magnetizable reed switches, a magnetic member attached to the sheet edge guide and controls for counting and moving the magnetic member relative to a selected magnetizable reed switch through a first motion in a first direction for a first total number of counts, and through a second motion in a second and opposite direction for a second total number of counts equal to one-half the first total number of counts.

9 Claims, 5 Drawing Sheets

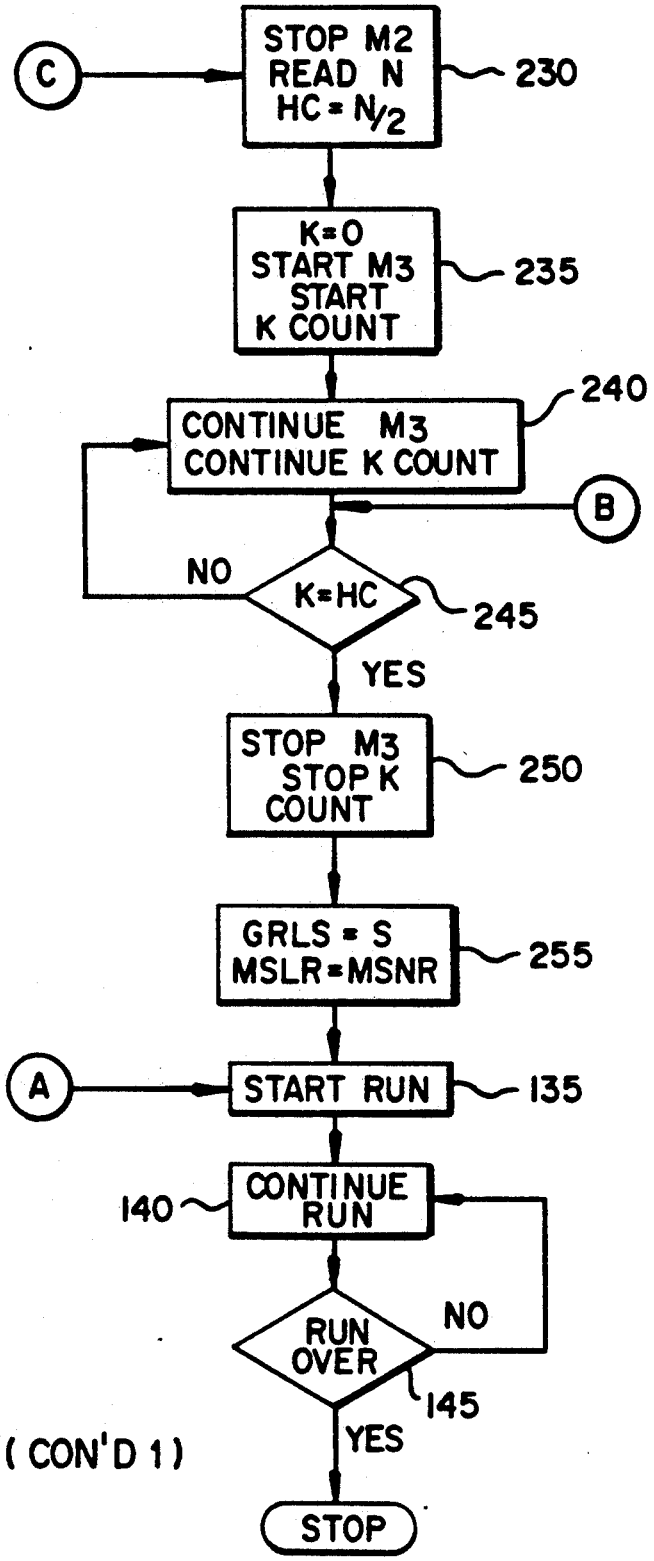
FIG. 5 (CON'D 1)

SHEET HOLDING TRAY HAVING ADJUSTABLE SHEET EDGE GUIDES AND METHOD FOR ADJUSTING SHEET EDGE GUIDES

BACKGROUND OF THE INVENTION

1. Technical Field

This invention relates to electrostatographic reproduction apparatus, and more particularly, to a sheet holding tray in such apparatus having accurately positionable adjustable sheet size guides.

2. Background Art

In modern reproduction apparatus, such as electrostatographic copiers or printers, for example, a latent image of information to be reproduced or copied, is formed on a uniformly charged dielectric member by altering the charge thereon in an image-wise pattern. The latent image charge pattern is then developed with toner or pigmented marking particles. Thereafter, the developed image is transferred to a selected copy sheet of a particular size and fixed to such sheet by applying heat and/or pressure thereby forming the desired reproduction or copy.

In order to improve the productivity of such reproduction apparatus, it is known to provide therein logic and control means, copy sheet feeding and copy handling means, and sheet paths all capable of enabling the apparatus to reproduce or copy information on both sides of a copy sheet. Reproduction apparatus enabled as such are said to be capable of performing duplex copying. Duplex copying may be accomplished in a single pass of a copy sheet through the reproduction cycle of a reproduction apparatus (single pass duplexing), or in two passes of the copy sheet through the reproduction cycle (double pass duplexing). For single pass duplexing, developed images of appropriate information are transferred respectively to each side of a copy sheet and then fixed simultaneously to such sheet. On the other hand, for double pass duplexing, a receiver sheet feed path is provided and includes an intermediate or duplex sheet holding tray in which receiver sheets, after each receiving and having a developed first image on a first, fixed side thereof, are held and then refed seriatim at a subsequent time from the duplex or intermediate tray for each receiving a second image on the second and opposite side thereof. The developed second images on the second sides are thereafter also fixed by applying heat and/or pressure.

While double pass duplex copying is typically somewhat slower in overall reproduction productivity than single pass duplex copying, double pass duplex copying does simplify handling of copy sheets during transport to the fixing device. This is due to the fact that only one side of each copy sheet being fed to the fixing device bears an unfixed toner image. However, the use of an intermediate or duplex sheet holding tray in reproduction apparatus as above for duplex copying undesirably exposes the reproduction apparatus to the possibility of several operational problems. For example, after a first image is fixed on the first side of a copy sheet, such sheet must be held in a duplex tray and refed such that the second image is properly registered on the second side of such sheet. As disclosed for example in U.S. Pat. No. 4,949,134, it is known to provide sheet edge guides in a sheet holding duplex or intermediate tray for aligning sheets held temporarily within such tray in order to improve subsequent refeeding and registration of the sheet.

Because reproduction apparatus use different size sheets, this, however, means that such sheet edge guides of the duplex tray must be positioned, moved and repositioned with substantial precision each time a different size copy sheet is to be used in the reproduction apparatus. Imprecise positioning of these guides, of course, results in poor sheet alignment within the tray and subsequently in poor image-to-sheet registration at image transfer. Over-travel movement, (i.e., movement that requires the sheet edge guides to always return to a home position which is marked by a limit switch) is additionally time consuming and slow. In particular, recovery times in such a home-position controlled system is very slow following an accidental power shutdown of the power supply of such a system because it has to be started all over to work.

SUMMARY OF THE INVENTION

It is an object of the present invention to provide, in a reproduction apparatus having a logic and control unit and a sheet holding or storage tray, a mechanism for automatically positioning with substantial precision a movable sheet edge guide of the tray at one of a selectable sheet size alignment positions of the tray.

It is also an object of the present invention to provide in such a reproduction apparatus, means for storing in the event of a power failure, and recovering, the motion status and position of the sheet edge guide thereof.

In accordance with the present invention the mechanism for automatically positioning the sheet edge guide of a sheet storage tray in order to align a sheet of a selected size being held in the tray, includes magnetizable reed switches fixedly mounted one each at a position associated with each of the selectable sheet size alignment positions of the sheet storage tray. The mechanism of the present invention also includes drive means for moving the sheet edge guide, and a magnetic member that is connected to the sheet edge guide for movement therewith relative to each of the magnetizable reed switches. The magnetic member has a zone of magnetic influence over each of the magnetizable reed switches. The mechanism of the present invention further includes control means, having counting means, for causing the drive means to move the sheet edge guide so as to move the magnetic member for a first total number of counts in a first direction completely across the zone of magnetic influence thereof over the magnetizable reed switch for a selected sheet size alignment position, and for a second total and different number of counts in a second and opposite direction back partially over the same zone of magnetic influence.

In another aspect of the present invention, the reproduction apparatus has means including a non-volatile memory for storing and recovering the motion status, and position, of the magnetic member and of the connected sheet edge guide with reference to the first and second motions and to the first and second total number of counts.

BRIEF DESCRIPTION OF THE DRAWINGS

In the detailed description of the invention presented below, reference is made to the drawings in which.

DETAILED DESCRIPTION OF THE INVENTION

Because electrostatographic reproduction apparatus having copy sheet storage trays are well known, the present description will be directed in particular to elements thereof which form part of or cooperate more directly with the present invention. Elements thereof not specifically shown or described herein are assumed selectable from typical elements known in the prior art.

Figure 1:
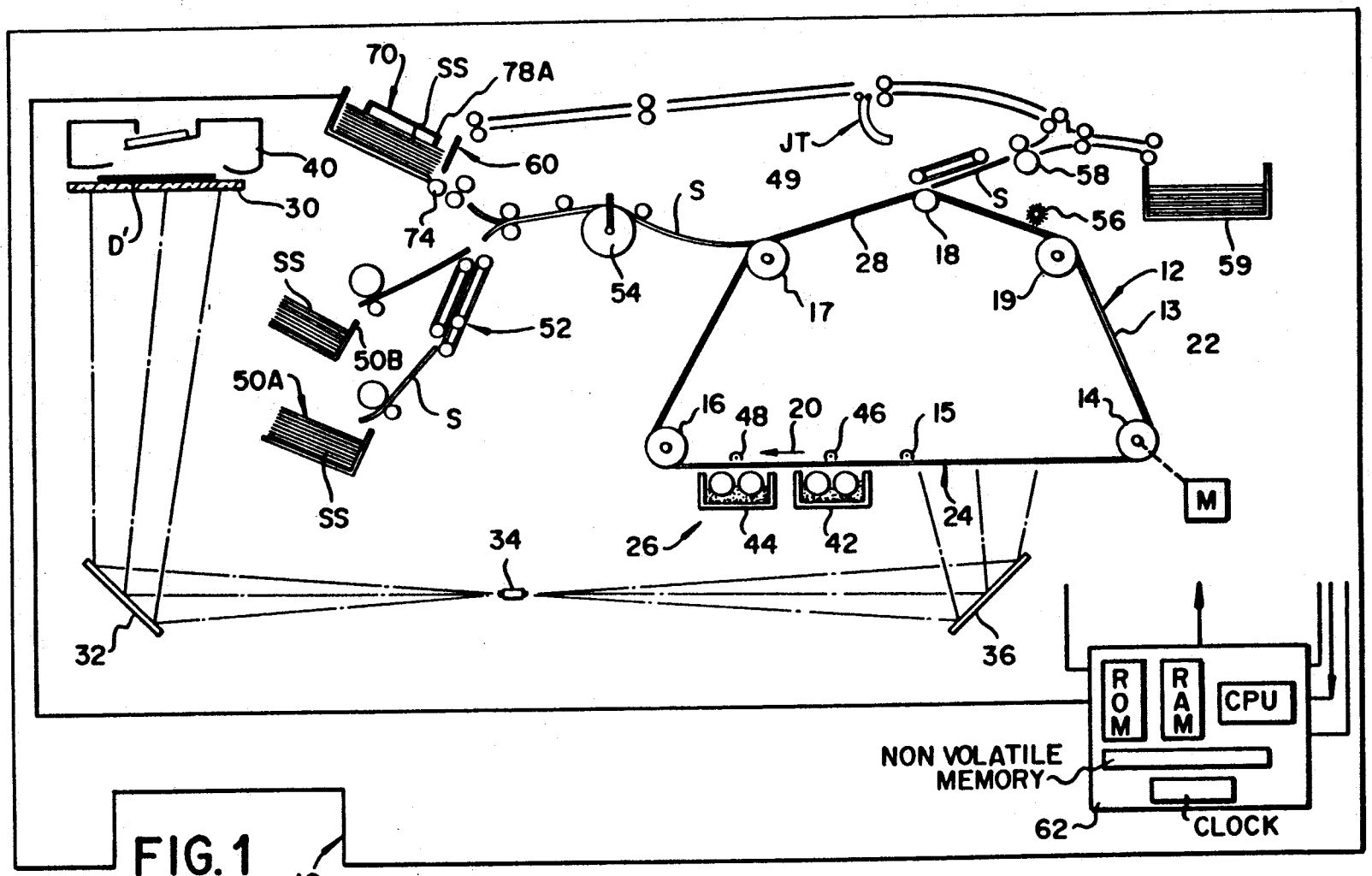
FIG. 1 is a schematic illustration of a reproduction apparatus including a sheet storage tray incorporating the sheet guide positioning mechanism of the present invention.
Figure 2:
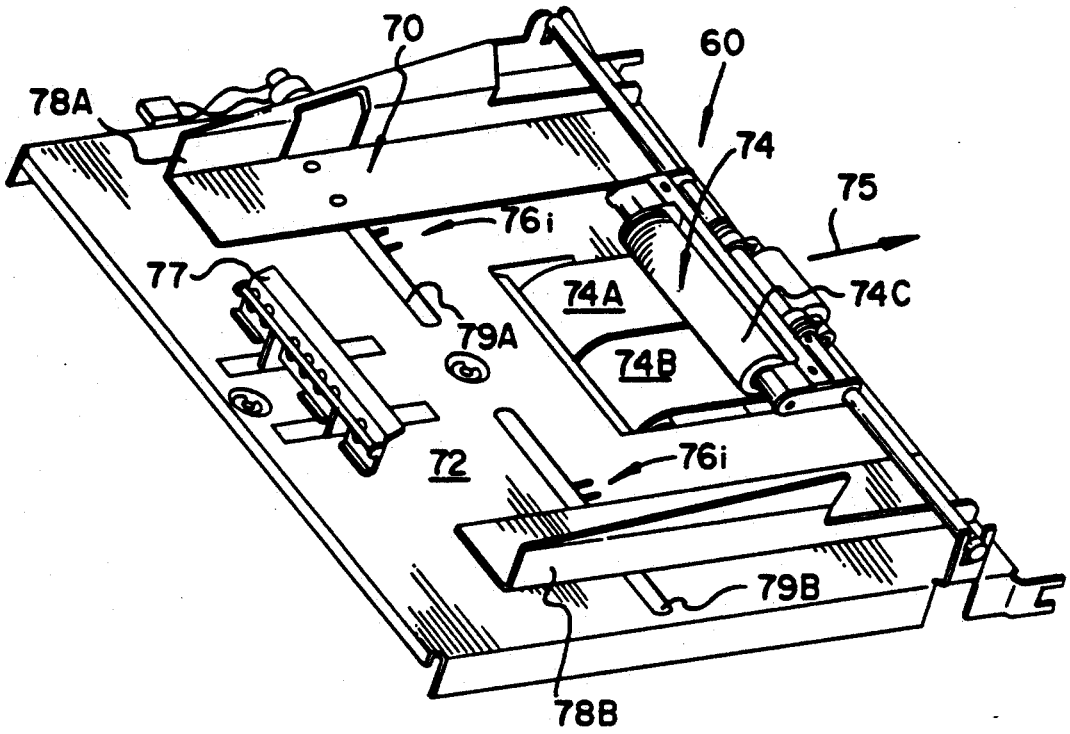
FIG. 2 is a view in perspective of the sheet storage tray of FIG. 1.
Figure 3:
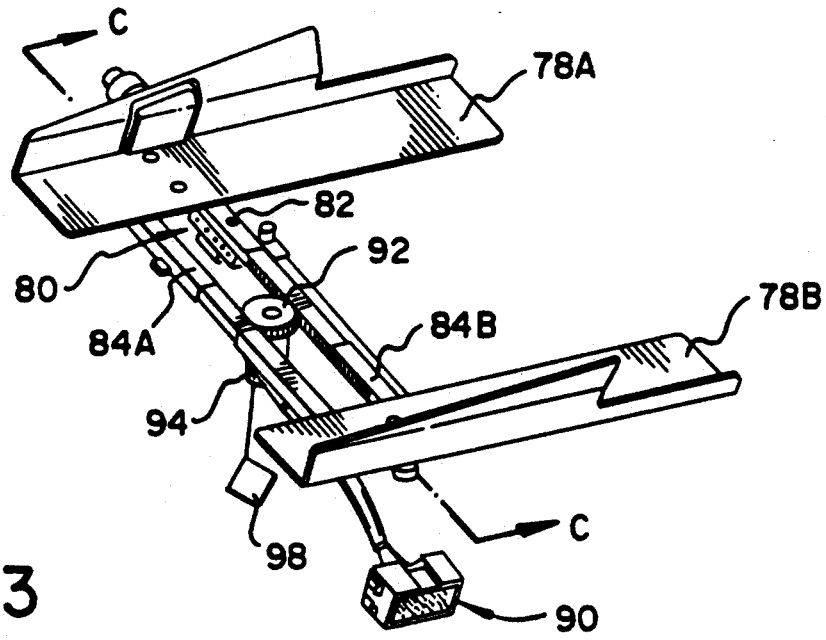
FIG. 3 is a view of the sheet edge guides and drive means therefor of the mechanism of the present invention.

Referring now to FIG. 1, an exemplary electrostatographic reproduction apparatus such as a copier is designated generally by the numeral 10 and is suitable for producing copies of an original image on one or both sides of suitable image-receiving or copy sheets. As shown, the apparatus 10 includes an image-forming dielectric member 12 having a front surface 13 that is divisible into imaging and non-imaging areas. The member 12, for example, can be a photoconductive web that is trained about a series of transport rollers shown as 14, 15, 16, 17, 18 and 19. The roller 14 is a drive roller and is coupled to a motor M for driving the member 12 in the direction, for example, of the arrow 20. Such movement of the member 12 causes successive imaging areas of the front surface 13 thereof to sequentially pass a series of electrophotographic process stations. As shown, such process stations include a charging station 22 at which each imaging area of the surface 13 receives a uniform layer of electrostatic charges. After the charging station 22, the other stations are an exposure station 24, a development station 26 and an image-transfer station 28.

At the exposure station 24, a latent electrostatic image is formed on the surface 13 by electronic means as is well known, or by optical means. For example, optical light reflected from an original document D' positioned on a transparent platen 30 is projected onto an object mirror 32, through a lens-shutter system 34 and from an image mirror 36 onto a selected imaging area of the charged surface 13 of the photoconductor 12. Such a light projection imagewise dissipates portions of the charge layer on the imaging area to optically form the latent electrostatic image of the original image on the document D'. The reflected light may be achieved, for example, by means of flash lamps (not shown) as is well known in the art.

The latent electrostatic image formed at the exposure station 24 is thereafter developed, that is, made visible with marking or toner particles at the development station 26. As shown, the development station 26 may include at least a development apparatus such as magnetic brush apparatus 42, 44 positioned adjacent the surface 13, and across backup rollers 46 and 48, respectively, for applying charged toner particles which adhere to the electrostatic latent image thereby forming a developed toner image on such surface 13.

At the transfer station 28, the toner image is transferred from the surface 13 onto a first side of a copy sheet S, for example, by electrostatic means using a corona charger 49. The copy sheet S is fed seriatim from a sheet supply unit 50A, 50B of such sheets by transport means 52 and through a registration gate 54 for receiving the toner image, in registration, at the station 28. As is well known, the registration gate 54 times the arrival of the sheet S at the transfer station 28 with the arrival thereat of the toner image on the moving member 12. At the transfer station 28, the charger 48 provides an electric field that causes an attraction of the toner image from the surface 13 of member 12 to the sheet S. After such toner image transfer, the transferring area of the surface 13 then moves past a cleaning element 56 which removes any residual particles from the image transferring area thus preparing the area for reuse. Meanwhile, if the apparatus 10 is in the simplex (or image on one-side) mode, the copy sheet S (now carrying the toner image) is moved through a fusing apparatus 58 and into an output device such as a tray 59.

On the other hand, if the reproduction apparatus 10 is to function in a double-pass duplex mode, then the copy sheet S, after passing through the fusing apparatus 58, is moved through an alternate sheet transport path 59A that includes a sheet turnover device JT for temporary storage in the duplex sheet storage tray of the present invention designated generally by the numeral 60 (to be described in detail below). The sheets S (now each carrying a fused image on a first side) are accumulated in a stack SS in the duplex sheet storage tray 60 for subsequent refeeding by means shown as 74, through the registration gate 54, and back to the transfer station 28 for receiving a second image on the second side thereof. For properly aligning the stack SS of such sheets in the tray 60, the tray has sheet edge guides including a guide shown as 78A (FIG. 1), and a mechanism 70 of the present invention (to be described in detail below) for automatically positioning the sheet edge guides at a selected one of various selectable alignment positions for stacks of sheets of various sizes.

For monitoring and controlling the operation of the various stations and elements of the machine or reproduction apparatus 10, a logic and control unit (LCU) 62 is included. As is well know, the LCU 62 includes stored programs which control machine functions, and which sequentially actuate and deactuate operative elements of each of the process stations and mechanisms therein in response to monitored input signals. The LCU 62, for example, may include a non-volatile memory portion, input/output circuit boards, a bus structure consisting of a series of addresses, data and control signal lines, and a central processing unit (CPU). The CPU includes a test point, communication chips and two microprocessors, for example, an INTEL8032 and an INTEL80286 which are used for memory storage, for communication with other dedicated microprocessors within the apparatus 10, and for controlling all other functions of the apparatus 10 that are not controlled by a dedicated microprocessor. The second microprocessor of the CPU, for example, the INTEL80286 includes ROM, RAM and one-time programmable features, and is used for temporary storage of information generated by the CPU for machine control.

Referring now to FIGS. 1-5, the sheet storage tray and mechanism of the present invention are illustrated in more detail. Although the present invention is being described with particular reference to a duplex tray, it is understood that it is equally useful and applicable to other sheet storage trays such as sheet supply, sheet stapling and sheet output trays having adjustable sheet edge guides. As illustrated, the sheet storage tray, for example, the duplex tray 60 includes a substantially planar sheet holding surface 72 (FIG. 2) for holding a sheet S or a stack SS (FIG. 1) of such sheets thereon in a desired alignment. The tray 60 has a sheet feedhead 74 that comprises driven feed belts 74A, 74B and a sheet stack retard roller 74C for feeding sheets seriatim for the bottom of a stack on the holding surface 72 in a direction shown by the arrow 75 (see FIG. 2). The tray 60 also has a plurality of selectable positions **76*i* for the alignment of stacks SS of different size sheets S (FIG. 1) on the surface 72. For aligning such stacks, the tray 60 includes a back edge guide 77 for aligning stacks in a back-to-front direction against the retard roller 74C, and a pair of side edge guides 78A, 78B that are movable through a pair of slots 79A, 79B respectively for positioning each at a selected one of the selectable sheet size alignment positions 76*i***.

For reliable feeding of sheets from the tray 60, and for desired side-to-side registration of a fed sheet to a toner image to be transferred thereonto, the tray 60 includes the mechanism 70 of the present invention which is useful for automatically positioning each of the sheet edge guides 78A, 78B, with substantial precision, at a selected sheet alignment position therefor. The mechanism 70 includes an assembly 80 having a plurality of magnetizable reed switches $R_1$, $R_2 \ldots R_7$ (FIG. 4A) that are mounted fixedly, one each at a position associated with each of the selectable sheet size alignment positions **76*i***, respectively. For example, as shown, each magnetizable switch $R_1$ to $R_7$ can be mounted at a position that is displaced from its associated sheet alignment position by a constant distance. Each such magnetizable reed switch $R_1$, $R_2 \ldots R_7$, for example, can be a single pole, single throw switch that is normally open but that is closable or actuatable by magnitization under the influence for example of a permanent magnet. The switches $R_1$ to $R_7$ are mounted each spaced apart (FIG. 4A) a desired distance $D_1$ from the next switch.

The mechanism 70 also includes a magnetic member 82, for example a bar of permanent magnet, that is connected by means of a rack member 84B to the sheet edge guide 78B, and a constant distance from the sheet aligning part of the edge guide 78B, for movement with the guide 78B, in the direction of the arrow 85. Such movement with the guide 78B is relative to each of the magnetizable reed switches $R_1$ to $R_7$. During such movement as shown by the arrow 85, the magnetic member 82 will have a zone of magnetic influence bounded by points $ZS_i$-$ZE_i$ across each of the switches $R_1$ to $R_7$ as shown for example across $R_6$. The zone $ZS_i$-$ZE_i$ starts and ends at $ZE_i$ respectively, such that points $ZS_i$ and $ZE_i$ each lie substantially at the midpoint of the distance D1 between adjacent switches.

The mechanism 70 for automatically positioning the sheet edge guides 78A, 78B at a selected sheet alignment position further includes drive means shown generally as 86 for moving the sheet edge guide 78A, 78B as well as the magnetic member 82. The mechanism 70 also includes control means shown as 90, for controlling such movement so as to achieve the objectives of the present invention. The drive means 86 as shown includes a pinion and rack assembly comprising a pair of rack members 84A and 84B with properly located gear teeth portions for example 84C (FIG. 4A), and a pinion 92 that is driven by a motor 94. The motor 94 may be for example a stepper motor that is connected to a power supply 98 and whose stepping pulses can be used by the LCU for counting. The rack member 84A is connected, for movement therewith, to the sheet edge guide 78A, and the rack member 84B is connected similarly to the sheet edge guide 78B. The rack members 84A, 84B as such are mounted for simultaneous and centered reciprocating movement by the pinion 92. Accordingly, moving and positioning one of the sheet edge guides, for example sheet edge guide 78B, at a selected sheet alignment position thereof as represented by the associated positioning of the magnetic member 82 over a selected switch $R_1$ to $R_7$, also similarly and simultaneously positions the other and opposite edge guide 78A at its proper and corresponding sheet alignment position for the particular selected size of sheet. The drive means 86 can move both rack members and the connected sheet edge guides so as to move the magnetic member 82 in a side-to-side direction FIGS. 4A, 4B across each of the switches $R_1$ to $R_7$.

The control means 90 includes means 96 such as a magnetometer for sensing the magnetic field strength and magnetic field strength changes across each of the zones of magnetic influence $ZS_i$-$ZE_i$. The means 96 as such should be connected to each magnetizable reed switch $R_1$ to $R_7$ (which as described above are mounted spaced the distance D1 from the next switch such that the magnetic member 82, in moving from one switch to the next, has a point PO (between the $ZE_i$ point of one zone and the $ZS_i$ point of the next zone) of substantially no magnetic influence over either of switches adjacent such point PO. Accordingly, the means 96 is useful in detecting each such point PO as well as detecting the zone starting and ending points $ZS_i$ and $ZE_i$ for each switch $R_1$ to $R_7$. The control means 90 also includes program and counting means (FIG. 5) for execution by the LCU 62, as well as a non-volatile memory portion of the LCU 62, for controlling the movement of the magnetic member 82 relative to the switches $R_1$ to $R_7$ so as to position each of the sheet edge guides 78A, 78B with substantial precision at its selected sheet size alignment position **76*i***.

Figure 4A:
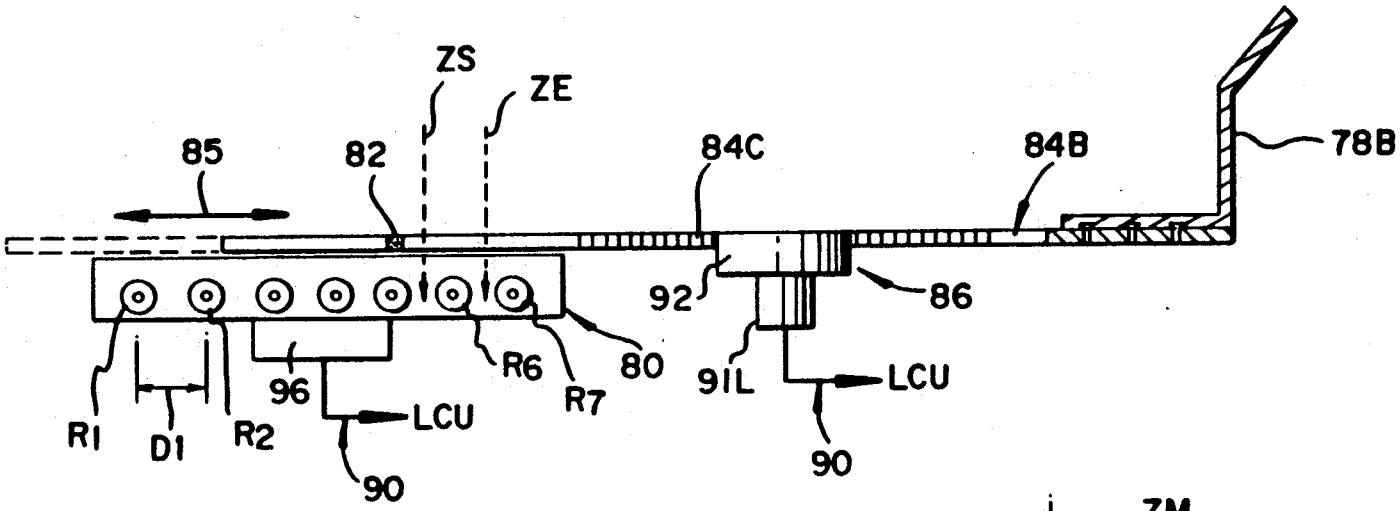
FIG. 4A is a front elevational view partly in section of a sheet edge guide of the present invention taken along the view plane C—C of FIG. 3, and including the magnetizable reed switches and magnetic member of the mechanism of the present invention.
Figure 4B:
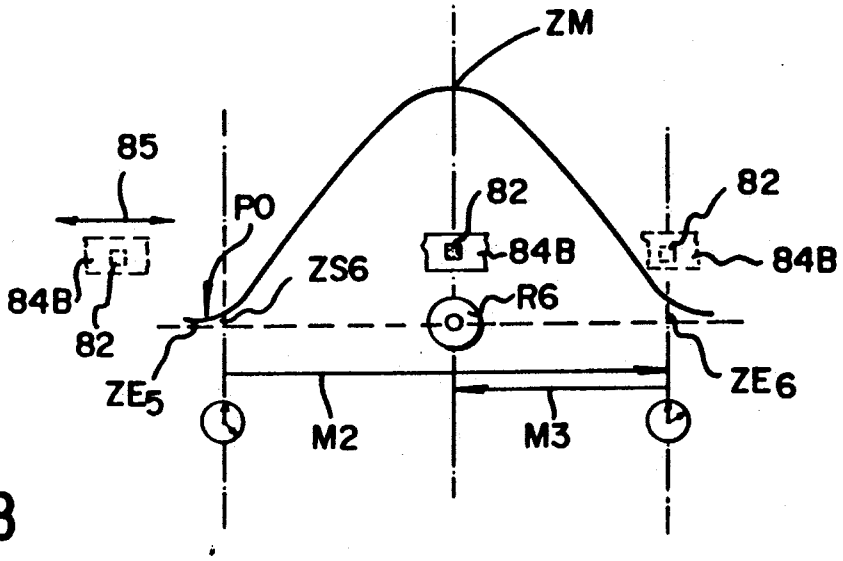
FIG. 4B is an illustration of a zone of magnetic influence across a magnetizable reed switch of FIG. 4A, for example across R6.
Figure 5:
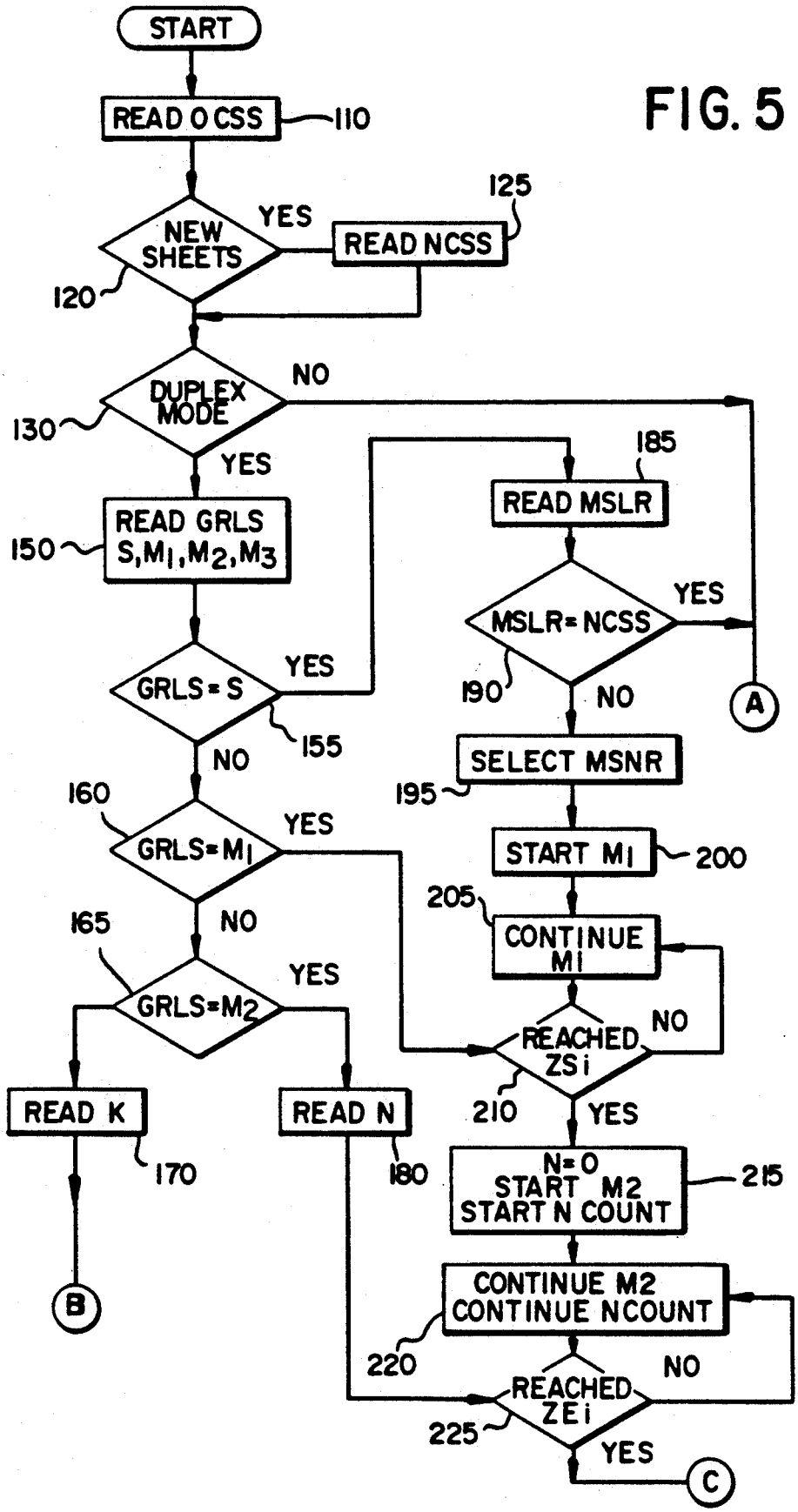
FIG. 5 is a flow chart of the method for automatically positioning the sheet edge guides of the duplex sheet storage tray of the present invention.

In accordance with the present invention, the control means 90, which includes an LCU clock, is useful for counting and moving the sheet edge guide 78B so as to move the magnetic member 82 to a stop, at a given speed, for a first total number of counts N through a first motion $M_2$ (FIGS. 4B, 5). As shown, the motion M is in a first direction completely crossing a zone of magnetic influence $ZS_i$-$ZE_i$ for example, $ZS_6$-$ZE_6$, of the magnetic member 82 (over the magnetizable reed switch among $R_1$ to $R_7$ for a particular selected sheet size alignment position **76*i*). This first motion $M_2$ and the count N therefor are started at the sensing (by the means 96) of magnetic influence ($=ZS_i$) following a point PO of substantially no magnetic influence, and before reaching the magnetizable reed switch for the particular selected sheet size alignment position. The first motion $M_2$ is stopped at a point ($=ZE_i$) downstream of the starting point $ZS_i$ whereat the magnetic field strength (as sensed by the means 96**) is substantially the same value as it was at the starting point $ZS_i$. As shown in FIG. 4B, the magnetic field strength across each of the switches $R_1$ to $R_7$ has a parabolic form with a maximum value ZM occurring at the center, and hence directly over the mounted reed switch, for example, $R_6$.

Because of likely variability from time to time and over time, in the speed at which the magnetic member 82 is being moved relative to the switches $R_1$ to $R_7$, and because of likely variability in the strength value for example of the magnetic field over each such reed switch, positioning the magnetic member 82 with substantial precision over such a selected reed switch is ordinarily not possible. As such, the control means 90 is next useful for moving the sheet edge guide 78B, after the stop of the first motion $M_2$ at $ZE_i$ (e.g. $ZE_6$), at the same speed, for a second total number of counts K, through a second motion $M_3$ (FIGS. 4B, 5). The second motion $M_3$ is started at the stopped point $ZE_i$ of the first motion $M_2$, and is in a second and opposite direction, as shown, partially back over that same zone of magnetic influence, until it is stopped when the second total number of counts K is equal to one-half the first total number of counts N.

Referring in particular to FIG. 5, the method of the present invention for automatically positioning the sheet edge guides 78A, 78B of the sheet storage tray 60 includes fixedly mounting a plurality of magnetizable reed switches one each at a reed position correspondingly associated with a selectable sheet alignment position of the sheet edge guides 78A, 78B. The method of the present invention also includes attaching a magnetic member 82 to the sheet edge guide 78B at a point that is displaced, from the sheet aligning part of the guide 78B, a distance equal to the displacement (if any) of each reed mounting position from its corresponding sheet alignment position. The method of the present invention further includes carrying out first and second motions of the magnetic member 82 relative to a magnetizable reed switch associated with a selected sheet alignment position. The first motion involves moving the sheet edge guide so as to move the magnetic member to a first stop, in a first direction, for a first total number of counts, completely crossing a zone of magnetic influence of the associated magnetizable reed switch. The second motion then involves moving this sheet edge guide from the first stop to a second stop, in a second and opposite direction partially back over that same zone of magnetic influence for a second total number of counts that is equal to one-half the first total number of counts.

In accordance with another aspect of the present invention as shown in FIG. 5 the LCU 62 includes a non-volatile memory portion and means for recording to and reading therefrom (and at any time during the automatic positioning of the sheet edge guides 78A, 78B), the motion status and the position status of the magnetic member 82 with respect to the reed position switch associated with a selected sheet alignment position, as well as with respect to the first and second total number of counts.

In accordance to the method of the present invention, when an operator pushes the start button to run a certain number of copies in a copy run, the mechanism 70 reads OCSS (box 110) which amounts to an identification of the last copy sheet supply unit 50A, 50B. It then senses whether a new and different sheet supply unit NCSS (boxes 120, 125) has been selected instead of OCSS. Next, it senses when a double pass duplex mode (box 130) has been selected for the current copy run, and if not, the run is started (box 135) and completed (boxes 140, 145).

If the double pass duplex mode is selected for the current run (or the apparatus 10 is recovering from a run interruption), the last motion status and position status GRLS of the magnetic member 82 with respect to the magnetizable reed switch for a selected sheet alignment position is read (box 150). The status GRLS can be S (stationary); $M_1$ (moving towards the zone of magnetic influence over the reed switch for the selected sheet alignment position); $M_2$ and $M_3$ as explained above for N and K counts respectively (boxes 155–180). Ordinarily, the status of the magnetic member and the sheet edge guide should be S with a position MSLR at the magnetizable reed switch for the copy sheets from the last run (box 185). If the stationary sheet edge guide position for the last run is the same as it is for the current run (box 190) then again the current run is started and completed (boxes 135–145).

If the stationary sheet edge guide position of the last run is different from that selected for the current run, then a new magnetizable reed switch MSNR is selected for general movement $M_1$ there towards and for the automatic guide positioning first and second motions $M_2$ and $M_3$ of the present invention for first and second total counts N and K where K is equal to one-half N (boxes 195–155).

The invention has been described in detail with particular reference to preferred embodiments thereof, but it will be understood that variations and modifications can be effected within the spirit and scope of the invention.

I claim:

1. In a reproduction apparatus having a logic and control unit, and a sheet storage tray including selectable sheet size alignment positions and a movable sheet edge guide, a mechanism for automatically positioning the sheet edge guide at a selected one of the alignment positions, the mechanism comprising:

(a) magnetizable reed switches mounted fixedly one for each of the selectable sheet size alignment positions of the sheet storage tray;

(b) a magnetic member connected to said movable sheet edge guide for movement therewith relative to each of said magnetizable reed switches, said magnetic member having a zone of magnetic influence over each of said magnetizable reed switches;

(c) drive means connected to the logic and control unit and to said sheet edge guide for moving said sheet edge guide, and said magnetic member relative to said magnetizable reed switches; and (d) control means for counting and moving said magnetic member at a particular speed for a first total number of counts through a first motion in a first direction, completely crossing a zone of magnetic influence thereof over a magnetizable reed switch for a selected sheet size alignment position, and for counting and moving said magnetic member at said particular speed for a second and different total number of counts through a second motion in a second and opposite direction partially back over said zone of magnetic influence.

2. The mechanism of claim 1 wherein said magnetizable reed switches are mounted spaced apart such that said magnetic member has a point between adjacent reed switches of substantially no magnetic influence over either of said adjacent switches.

3. The mechanism of claim 2 wherein each of said first and second motions is started and counted at the sensing of magnetic influence immediately following a point of substantially no magnetic influence, and upstream of the magnetizable reed switch for said selected sheet size alignment position.

4. The mechanism of claim 2 wherein said drive means includes a stepper motor.

5. The mechanism of claim 4 wherein said drive means includes a pinion and rack assembly having a driven pinion and a movable rack connected to said movable sheet edge guide.

6. The mechanism of claim 4 wherein said control means includes a magnetic field strength sensor connected to each of said magnetizable reed switches for detecting said points of substantially no magnetic influence adjacent a magnetizable reed switch associated with a selected sheet size alignment position.

7. The mechanism of claim 4 wherein said second total number of counts for said second motion is equal to one-half said first total number of counts for said first motion.

8. The mechanism of claim 5 including a second movable sheet edge guide connected to a second rack of said pinion and rack assembly.

9. In a reproduction apparatus including a logic and control unit and a sheet storage tray having selectable sheet size alignment positions and a movable sheet edge guide, a method for accurately positioning the movable sheet edge guide at a selected sheet size alignment position, the method comprising the steps of:

(a) fixedly mounting a plurality of magnetizable reed switches one each at a position associated with one each of said selectable sheet size alignment positions;

(b) attaching a magnetic member to said movable sheet edge guide;

(c) first moving said sheet guide so as to move said magnetic member to a first stop through a first motion in a first direction for a first total number of counts completely crossing a zone of magnetic influence of said magnetic member over the magnetic reed switch for a selected sheet size alignment position; and (d) secondly moving said sheet guide so as to move said magnetic member from said first stop to a second stop through a second motion in a second and opposite direction back over said zone of magnetic influence for a second total number of counts equal to one-half said first total number of counts.

* * * * *